United States Patent [19]

Rekewitz et al.

[11] 4,166,314

[45] Sep. 4, 1979

[54] MAGNETICALLY ACTUATED NEEDLE PRINTING HEAD AND METHOD OF MANUFACTURE

[75] Inventors: Rudolf Rekewitz, Weidach; Peter Kuelzer, Munich, both of Fed. Rep. of Germany

[73] Assignee: Siemens Aktiengesellschaft, Berlin & Munich, Fed. Rep. of Germany

[21] Appl. No.: 776,266

[22] Filed: Mar. 10, 1977

[30] Foreign Application Priority Data

Mar. 24, 1976 [DE] Fed. Rep. of Germany ..... 2612585

[51] Int. Cl.[2] ..... B21K 25/00

[52] U.S. Cl. ..... 29/517; 400/124; 400/719

[58] Field of Search ..... 197/1 R; 29/525, 451, 29/517; 400/124

[56] References Cited

U.S. PATENT DOCUMENTS

| | | | |
|---|---|---|---|
| 2,214,491 | 9/1940 | Tondeur | 29/451 X |
| 3,046,824 | 7/1962 | Mohr | 29/525 X |
| 3,058,764 | 10/1962 | Scott et al. | 29/525 |
| 3,577,850 | 5/1971 | Harris | 29/517 |
| 3,748,723 | 7/1973 | Tomioka | 29/517 |
| 3,787,791 | 1/1974 | Borger et al. | 197/1 R |
| 3,850,278 | 11/1974 | Mihm et al. | 197/1 R |
| 3,897,865 | 8/1975 | Darwin et al. | 197/1 R |
| 4,051,940 | 10/1977 | Kuelzer | 197/1 R |

FOREIGN PATENT DOCUMENTS

| | | | |
|---|---|---|---|
| 2352698 | 5/1974 | Fed. Rep. of Germany | 197/1 R |
| 2436669 | 4/1976 | Fed. Rep. of Germany . | |
| 2281834 | 12/1976 | France | 197/1 R |

*Primary Examiner*—William Pieprz

*Attorney, Agent, or Firm*—Hill, Van Santen, Steadman, Chiara & Simpson

[57] ABSTRACT

A magnetically actuated printing needle of the type used in mosaic needle printing heads having printing needles moved by an axially movable armature connected to the needle is disclosed wherein the needle is provided with an armature received portion having a varying surface configuration locked into a bore in the armature by cold press forming of the armature after the needle is inserted thereinto.

4 Claims, 3 Drawing Figures

MAGNETICALLY ACTUATED NEEDLE PRINTING HEAD AND METHOD OF MANUFACTURE

BACKGROUND OF THE INVENTION

1. Field of the Invention

This invention relates to mosaic needle printing heads and more particularly to needle printing systems utilizing printing needles activated by linearly moving magnet armatures.

2. Prior Art

A known type of printing mechanism utilizes a printing head having a mosaic of blunt ended needles selectively projectable from a printing head face. One method of moving the needles to bring them into projected printing positions is to attach the end of the needle opposite the printing end to the armature of a plunger type magnet system such as a miniature magnetic solenoid.

In the manufacture of such mosaic needle printing devices, the interconnection between the individual printing needles and the armatures of the electromagnet systems creates a number of relatively unique and critical problems. Many of these problems can be identified as being a function of the relatively small size of the printing needles used in such printing mechanisms. Needles having a diameter less than 0.4 mm are common. Thus dimensional restrictions create a number of problems which would not be encountered in larger plunger type electromagnetic systems.

As a further complicating factor, in order to obtain a sufficiently long service life the printing needles themselves have to be both wear and fracture resistent. Those materials which exhibit the desired wear and fracture resistent properties have been found, through experience, to be relatively incompatible with the optimum materials for construction of the electromagnet armatures. A particular area of incompatibility lies in the joining together of the needle and the armature. Again, due to the size of the overall system, it is very important to choose the material for the electromagnet armature with a high regard for its ferromagnetic property as opposed to choosing an armature material having the best connection compatibility with the needle.

Yet another series of problems arises from the fact that when utilizing plunger type armature electromagnetic systems in mosaic needle printing devices, the connection of the printing needle into the receiving bore hole in the armature requires that the bore have a small diameter approximating the diameter of the needle while having a relatively long depth. These very small diameter but long bores have to be centrally placed in the armature. Production of such bore holes within required tolerance limits is very expensive.

Attempting to make the connection between the armature and the needle by heat connection systems such as soldering or welding adds additional complexity. The heat treatment required by such connection systems often creates structural damage to the materials being used, both to the armature and to the needle, which structural damage is aggravated by the very small dimensions used.

In any type of connection system, close attention has to be paid to insure that the printing needle and the armature are substantially completely axially aligned. Failure to obtain proper alignment will introduce a tilting of the armature in the magnet which will thereafter result in an improper catching of the armature during movement.

Nor can these difficulties be overcome through the standard expedients press fit or interference fit of the needle end into the armature. The material of the armature will not have, due to the very small dimension of the bore hole, a sufficient elasticity to provide a desired tight grip on the needle.

Because of some of the above difficulties, it has been suggested to provide printing needles which are received in blind ended bores in the armature and which are held along the cylindrical side wall of the bores by elastically deformable means. One line of reasoning for this type of construction proceeds from the fact that the forces which effect the fastening between the plunger type armature and the printing needle are extremely diverse. Such forces are applied from many differing directions during printing however their strength varies according to direction. Thus forces securing the needle in the armature can vary according to different directions while still providing a sufficiently safe functional fastening. The greatest force occurs axially and such blind hole bores positively intercept the force at the base of the blind hole whereas forces opposite to the printing force are relatively lesser and can be accounted for by the frictional grip of the needle along the length of the cylindrical wall.

SUMMARY OF THE INVENTION

It is a principle objective of the present invention to provide a mosaic needle printing head construction utilizing plunger type magnets having moving armatures in which the connection between the printing needle and the armature can both be produced simply and inexpensively and can none the less provide a functionally safe positive lock between the needle and the armature.

This objection is met by providing a mosaic needle printing head section having a plunger type armature gripping a printing needle wherein the printing needle has an axial portion extending into the armature which is laterally deformed and which is positively embedded in the armature by means of a cold press shaping of the armature after receipt of the needle end.

The intimate positive lock created by embedding the needle in the plunger type armature after laterally deforming the printing needle can be carried out simultaneously with calibration of the exterior diameter of the armature. This can be done during production by means of cold press techniques such as axial forging of the armature. In such an operation material of the armature flows both to the outside and to the center and will thereby encircle and surround the laterally deformed printing needles axial end section in the armature. No destructive stress is applied to the material of the printing needle during this process so that no predisposition to breaking is imparted to the printing needle material such as would otherwise occur by operations which may produce sufficient forces on the needle to create structural changes within the needle such as surface fractures. A soft iron or mild steel, for example, is particularly suitable for use as the material of the armature and exhibits the required magnetic properties while being easily cold shaped.

Since the necessary calibrating of the exterior diameter of the armature can be carried out in a single work process which can be a joint work process with the mounting of the printing needle end in the armature, the production method disclosed is particularly favorable and inexpensive.

In one preferred embodiment described herein, the mosaic needle printing head subassembly is characterized by use of a printing needle end portion which projects into the armature and which is formed in a stamped wave shape configuration.

Particularly advantageously, we herein describe a construction wherein the armature inserted into the printing needle is coined into the desired wave shape together with a coated tube piece received therearound. The tube will thus represent a diameter reduction member between the bore hole of the armature and the printing needle. By utilizing this tube piece as a diameter reduction member, it is possible to form the bore hole within the armature larger than would otherwise be the case. This has a very favorable impact upon production costs of the armature particularly since small tubes with correspondingly small inner diameters can be produced relatively inexpensively by means of known methods such as, for example, extrusion.

A second needle deformation embodiment illustrated herein has the needle preformed such that the end of the needle which extends into the armature is formed with a bulbous section. When using this construction, it is advantageous to form the armature bore as a blind end bore hole and to utilize the base of the bore hole as a positive brace for the needle. The bulbous end of the needle can be formed by bending the needle back upon itself.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

DESCRIPTION OF THE PREFERRED EMBODIMENTS

Figure 1:
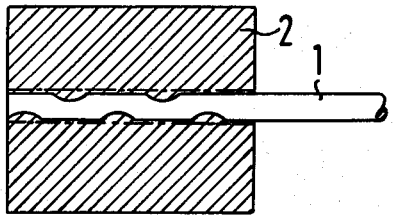
FIG. 1 is a fragmentary cross-sectional view of a wave shaped stamped needle impressed in an armature according to this invention.

As illustrated in FIG. 1, the armature attachment end 1 of a printing needle 1 is prestamped into a wave like configuration providing variations in the radial positioning of the surface of the needle from the axial center line along the axial length of the portion of the needle end which is received in the armature. The wave shape formation of the needle end preferably occurs before insertion of the needle end into a bore hole in the armature of a plunger type armature magnet system such as used in mosaic needle printing heads. The bore hole of the armature 2 is originally cylindrical having a constant diameter as indicated by the broken line of FIG. 1. In the course of calibration of the external dimensions of the armature, it is placed into a mold having the desired dimensions and is thereafter axially cold forged. During this cold press operation, the material of the plunger type armature 2 will flow not only to the exterior of the armature into contact with the mold walls, but also to the interior into mating surface contact with the needle. Thus upon completion of the cold press forging operation, the external surfaces of the armature will properly correspond to the inner surfaces of the mold or die and the inner bore wall will mate with the deformed surface of the printing needle 1. In this manner a positive lock connection will be created between the end of the printing needle and the armature without the necessity of any heat treatment.

Figure 2:
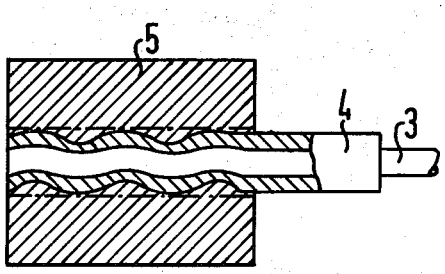
FIG. 2 is a view similar to FIG. 3 illustrating the use of a diameter reduction tube.

As illustrated in FIG. 2, a cylindrical tube member 4 can be inserted over the end of the needle which is to be inserted into the armature. The insertion of a cylindrical tube over the cylindrical needle is carried out as a first work step and as a second work step the insertion end of the needle and tube can be stamped or coined into the desired wave shaped configuration such that the end of the printing needle 3 and the end of the tube 4 will assume a complimentary shape. Thereafter the tube-needle end can be inserted into the cylindrical bore of the armature. The cylindrical bore, indicated by the broken line of FIG. 2 can be formed with a larger diameter than would otherwise be the case if the diameter reducing tube 4 were not utilized. Thereafter the material of the armature 5 can be formed in to configuration with the external surface of the tube by means of the cold shaping described above during the step of external dimension calibration of the armature.

Figure 3:
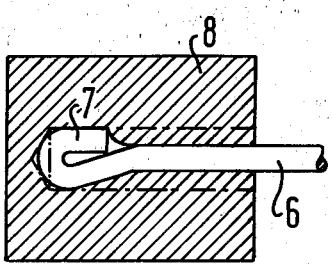
FIG. 3 is a view similar to FIG. 2 illustrating a bulbous ended needle received in a blind bore armature.

A third embodiment is illustrated in FIG. 3. In that figure, the printing needle 6 has an end portion 7 formed with a diameter increase. The diameter increase can be created by bending the needle end back upon itself as illustrated to create a bulbous ended needle. This needle is received, preferably, into a blind hole bore in the armature. The original relatively large diameter of the blind hole bore, as illustrated by the broken line of FIG. 3, is thereafter reduced to a diameter in conformity with the diameter of the needle 6 by means of the aforementioned cold shaping processes.

It can therefore be seen from the above that our invention provides an armature-printing needle connection for use in the construction of mosaic printing needle writing head subassemblies wherein the needle has an external varying radius shaped end received in a bore hole in an armature with the bore hole thereafter reduced into mating surface contact with the needle end by means of a cold pressing operation. This effectively locks the needle in the armature at the same time the armature is being properly calibrated for external size dimensions.

The resultant joint between the armature and the needle is sufficiently strong to withstand working conditions of the mosaic needle print head while at the same time being relatively inexpensive to achieve due to the production method involved.

Although the teachings of our invention have herein been discussed with reference to specific theories and embodiments, it is to be understood that these are by way of illustration only and that others may wish to utilize our invention in different designs or applications.

We claim as our invention

1. The method of manufacturing a mosaic needle printing head needle-armature assembly which comprises the steps of providing a ferromagnetic armature mass, providing a substantially cylindrical bore in said mass, providing a substantially cylindrical printing needle, coining an end portion of the needle to provide radially offset surface sections, inserting the end of the needle into the bore, cold forming the armature mass, radially moving material of the mass by said cold forming to constrict the bore to a point where the bore walls are radially flowed into substantial mating surface circumferential engagement with the length of the needle received in the bore wherein the external dimensions of the armature mass are finally sized simultaneously with the cold forming operation.

2. The method of claim 1 wherein cold forming is accomplished by a mold forming process.

3. The method of claim 1 wherein the offset surface sections are provided by bending an end of the needle back upon itself.

4. The method of manufacturing a mosaic needle printing head needle-armature assembly which comprises the steps of providing a ferromagnetic armature mass, providing a substantially cylindrical bore in said mass, providing a substantially cylindrical printing needle, providing a hollow cylindrical tube, said tube having an inner diameter substantially the same as the outer diameter of the printing needle, inserting an end portion only of the needle in the tube, coining an end portion of the needle and tube to provide radially offset surface sections, inserting the end of the needle and tube into the bore, cold forming the armature mass, radially moving material of the mass by said cold forming to constrict the bore to a point where the bore walls are flowed into substantial mating surface circumferential engagement with the length of the tube received in the bore, the tube being in circumferential gripping engagement with the printing needle.

* * * * *